US005282603A

United States Patent [19]

Taraldsson

[11] Patent Number: 5,282,603

[45] Date of Patent: Feb. 1, 1994

[54] CLAMPING AND FIXING DEVICE, FORM TIE AND FORM

[76] Inventor: Leif B. Taraldsson, Box 64, S-610 70 Vagnhärad, Sweden

[21] Appl. No.: 719,309

[22] Filed: Jun. 25, 1991

[30] Foreign Application Priority Data

Jan. 11, 1991 [SE] Sweden ..... 9100094

[51] Int. Cl.[5] ..... E04G 17/065; E04G 17/075

[52] U.S. Cl. ..... 249/35; 249/40; 249/43; 249/190; 249/192; 249/195; 249/216; 249/217; 249/219.1; 425/451.5; 425/451.9

[58] Field of Search ..... 249/38, 35, 39, 40, 249/47, 190, 191, 192, 193, 195, 213, 219.1, 216, 217, 180, 182, 43, 17, 148, 178, 184, 185; 425/592, 593, 451.5, 451.6

[56] References Cited

U.S. PATENT DOCUMENTS

| | | | |
|---|---|---|---|
| 3,464,667 | 9/1969 | Sledz | 249/190 |
| 3,690,613 | 9/1972 | Shoemaker | 249/40 |
| 3,754,717 | 8/1973 | Saidla | 249/180 |
| 4,159,097 | 6/1979 | Strickland | 249/190 |
| 4,341,511 | 7/1982 | Laurent et al. | 425/451.6 |
| 4,520,988 | 6/1985 | Walker | 249/178 |
| 4,520,990 | 6/1985 | Maier | 249/195 |
| 4,634,388 | 2/1987 | Tazawa | 249/190 |
| 4,726,560 | 2/1988 | Dotson | 249/190 |

FOREIGN PATENT DOCUMENTS

| | | | |
|---|---|---|---|
| 2905944 | 8/1980 | Fed. Rep. of Germany | 249/38 |
| 3503734 | 8/1986 | Fed. Rep. of Germany | 249/39 |
| 2566821 | 1/1986 | France | 249/195 |

*Primary Examiner*—Khanh Nguyen

*Attorney, Agent, or Firm*—Nies, Kurz, Bergert and Tamburro

[57] ABSTRACT

A clamping and fixing arrangement which functions to fixate the various elements of formwork or shuttering, preferably intended for moulding concrete. The arrangement is mainly characterized by an eccentric locking device which is provided with an expandable eccentric part and which has a predetermined axial extension in an expanded state and an axial extension which is smaller than the predetermined axial extension in a non-expanded state. The arrangement includes a form tie and related formwork or shuttering.

31 Claims, 5 Drawing Sheets

Fig. 11
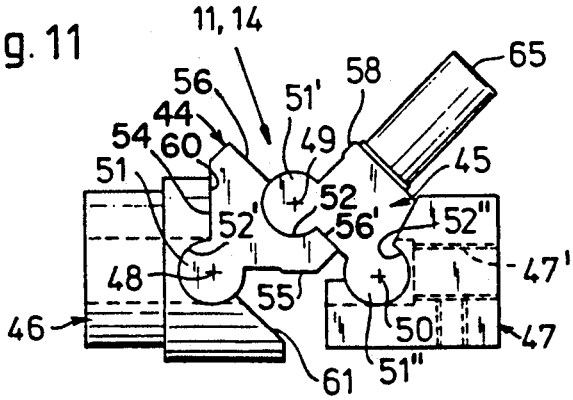
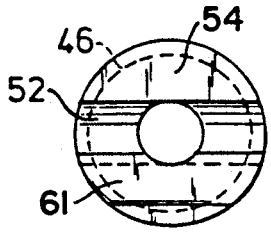
Fig. 13
Fig. 12
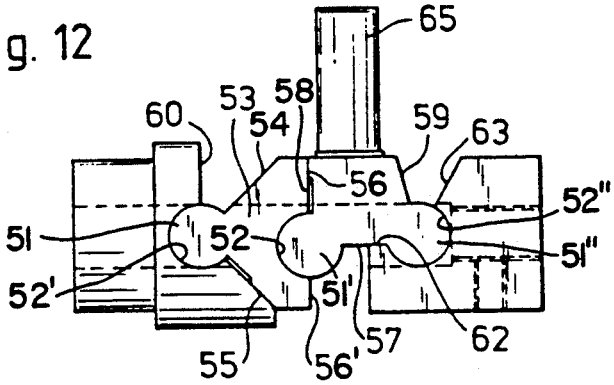
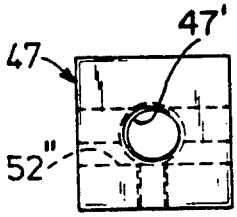
Fig. 14
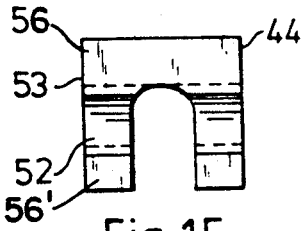
Fig. 15
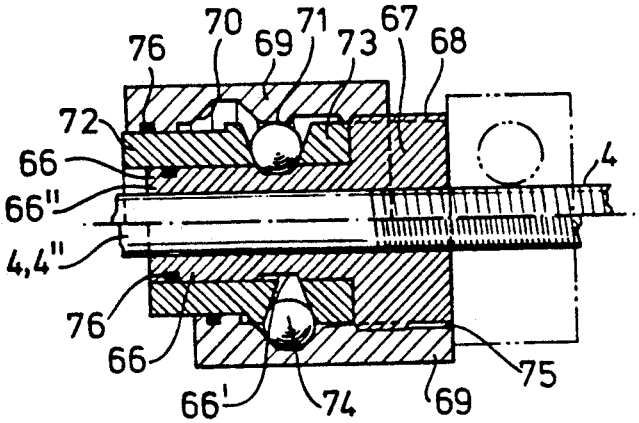
Fig. 17
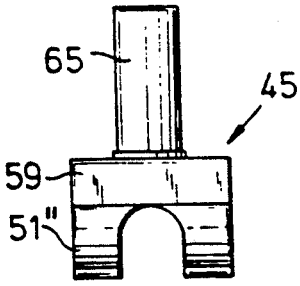
Fig. 16

CLAMPING AND FIXING DEVICE, FORM TIE AND FORM

BACKGROUND OF THE INVENTION

The present invention relates to a clamping and fixing device primarily intended for concrete forms or shuttering and functioning to hold various components, such as form elements, in desired mutual positions.

FIELD OF THE INVENTION

The invention also relates to a form tie intended primarily for concrete forms or shuttering and functioning to hold a form or shuttering comprising mutually opposing form bottoms provided with form boards or shuttering panels in desired positions. The concrete is intended to be cast against the form boards and the form will include at least one tension element which extends between opposing boards, and two fixating elements provided to secure the tension element externally of the boards, and will also include a sealing element in which the tension element is intended to extend between the boards and which effects a seal in the vicinity of two opposing holes in said boards, the tension element being intended to extend through said holes.

The invention also relates to a form, primarily a concrete form or shuttering.

According to known techniques, certain clamping and fixating problems are solved, at least when casting concrete is concerned, by means of wedging devices. One drawback with such arrangements is the loud noise that is generated when the wedges concerned are knocked into place and also when knocked out of place, with the aid of sledge hammers or the like. The present invention relates to a clamping and fixating arrangement which is extremely quiet and rapid, among other things.

RELATED ART

Form ties of essentially the aforesaid kind are known to the art. Swedish Patent Application No. 8405045-9 teaches a form tie which can be mounted from the outside of one of the opposing form bottoms, by passing a tension rod through mutually opposing holes in the boards and causing one end thereof to coact with a fastener element provided on the outside of the other form bottom, and fastening the tension rod on the outside of said one form bottom by means of a wedge arrangement. Also provided is an expandable sleeve which can be expanded into sealing engagement with said holes.

This known technique, and more conventional form-tie technique, is encumbered with serious drawbacks. For example, the wedge arrangement described above, which is also used in more conventional ties, frequently requires the use of sledge hammers or like tools, which results in injury, damage, noise pollution, etc. The known techniques are also highly time-consuming and problems are encountered with the reuse of sealing devices, among other things.

SUMMARY OF THE INVENTION

The drawbacks of the known techniques are not found with the present invention. Thus, the inventive form tie can be quickly removed in a simple and quiet manner. Injuries and damage are avoided, and the components can be reused to a very high degree.

The invention relates to a novel clamping and fixating arrangement which is primarily intended for concrete forms or shuttering and which is intended to hold individual form elements in desired mutual positions.

The arrangement is mainly characterized by an eccentric locking device which has an expandable eccentric part and which is intended to have a predetermined axial extension or length when expanded and a smaller axial extension of length than said predetermined length when not expanded.

The invention also relates to a form tie which is intended primarily for concrete forms or shuttering and which functions to hold in a desired position a form or shuttering that comprises opposing form bottoms provided with form boards, wherein the concrete is cast against the form boards; and which includes at least one tension element which extends between opposing boards; two tension-element fixating or securing elements located externally of the form boards; and a sealing element in which the tension element is intended to extend between said boards and which functions to seal two mutually opposing holes in the boards, said tension element being intended to extend through said holes.

The form tie is mainly characterized in that it includes a first fixating element which comprises an eccentric locking device which has an expandable eccentric part and which, in an expanded locking position, functions to provide a predetermined greatest distance between the form boards and to transmit tension forces acting in the tension element in the form of compression forces to the form bottom, at which the eccentric locking device is arranged.

The invention also relates to a form or shuttering for casting, primarily, concrete and comprising at least two form elements which are held fixated relative to one another by means of clamping and fixating devices, when casting is taking place. The form is mainly characterized in that the clamping and fixating devices include an eccentric locking device which is provided with an expandable eccentric part and which has a predetermined axial extension or length in its expanded state and an axial extension or a length which is shorter than said predetermined length when in its non-expanded state.

BRIEF DESCRIPTION OF THE DRAWINGS

The invention will now be described with reference to exemplifying embodiments thereof and also with reference to the accompanying drawings, in which

FIG. 11 illustrates schematically a second embodiment of eccentric locking, according to the invention, seen transversely to the expansion direction and parallel with the rotational axis or axes of the linkage arms provided, said Figure illustrating a non-expanded state of said eccentric locking device;

FIG. 12 illustrates the arrangement shown in FIG. 11 but with the eccentric locking device in its expanded state;

FIG. 13 illustrates a left-hand support part according to FIG. 11, seen from the right in said Figure;

FIG. 14 illustrates a right-hand support part according to FIG. 11, seen from the right in said Figure;

FIG. 15 illustrates a left-hand linkage arm according to FIG. 12, seen from the right in said Figure;

FIG. 16 illustrates a right-hand linkage arm according to FIG. 11, seen from the right in said Figure; and FIG. 17 is an axial section view through a second embodiment of a second fixating element, said Figure showing both the locked and the non-locked states.

DESCRIPTION OF THE PREFERRED EMBODIMENTS

Figure 1:
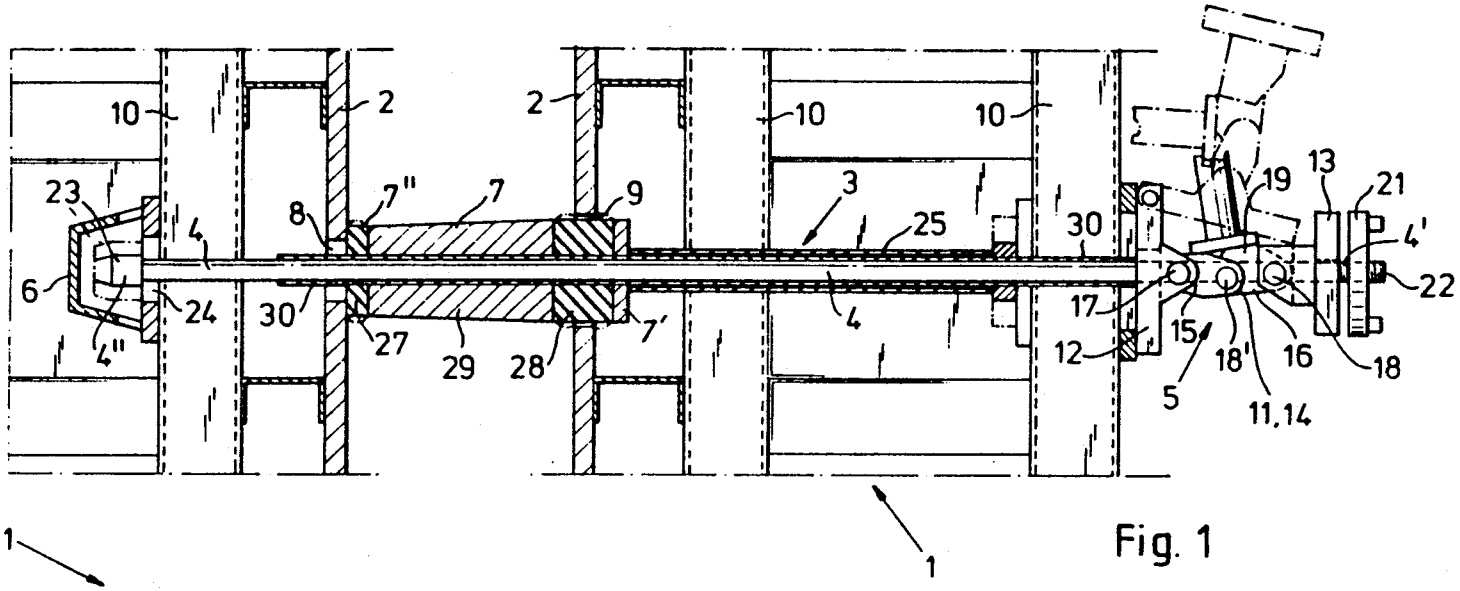
FIG. 1 is a schematic, vertical and central sectional view of a first embodiment of an inventive form tie mounted adjacent two form bottoms.

In FIG. 1, the reference numeral 1 identifies form bottoms, more specifically two mutually opposing form bottoms each of which includes respective form boards 2, wherein concrete or the like is intended to be cast between the form bottoms 1 against the form boards 2. The reference numeral 3 identifies a form tie which functions to hold the form bottoms, and therewith also the form boards, in desired mutual positions, and includes at least one tension element 4 which extends between the form boards 2 and connects the form bottoms, and at least two tension-element securing or fixating elements 5, 6 arranged externally in relation to the form boards, and a sealing element 7 through which the tension element is intended to pass between the panels and which is intended to lie sealingly against two mutually opposing holes 8, 9 in the form boards, said tension element extending through said holes.

In addition to the form boards 2, the form bottoms 1 also include load-bearing parts 10, for example in the form of vertically extending columns.

The reference numeral 5 identifies a first fixating or securing element which includes an eccentric locking device provided with an expandable eccentric part 11 and, when in an expanded locking state, providing a predetermined greatest distance between the form boards and also functioning to transmit the tension forces acting in the tension element during a casting operation to the form bottom in the form of compression forces, said eccentric locking device being mounted adjacent said bottom.

In the illustrated embodiment, the eccentric locking device comprises a first support part 12 which is intended to support against load-bearing parts 10 of the form bottom, such as load-bearing parts 10 in the form of form joists or columns 10, and a second support part 13 which is intended to support against a stop means located adjacent the tension element 4, so as to enable the tension element to be placed under tension. The support parts 12, 13 are pivotally connected to an eccentric, expandable linkage-arm arrangement 14 which in a first position or state, a non-expanded state, functions to hold the support parts 12, 13 close together in the direction of the longitudinal axis of the tension element, the tension element preferably being relieved of load, and, in a second positional state, an expanded state, functions to hold the support parts spaced from one another in the longitudinal direction of the tension element, said tension element optionally being placed under tension. FIG. 1 shows the aforesaid non-expanded state.

The illustrated embodiment includes linkage arms 15, 16 which are pivotally mounted on mutually parallel pivot shafts 17, 18, 18' which extend transversely to the longitudinal direction of the tension element, and which, in this case, are connected to respective support parts 12, 13. Some of the linkage arms 16 are connected to an eccentric 19 which can be pivoted around a pivot axis which extends substantially parallel with the pivot shafts or axes of the linkage arms, wherein the eccentric locking device is switched between its non-expanded state and its expanded state by rotating of the eccentric 19, and wherein the expanded state, and preferably also the non-expanded state, constitute stable eccentric locking states.

Figure 3:
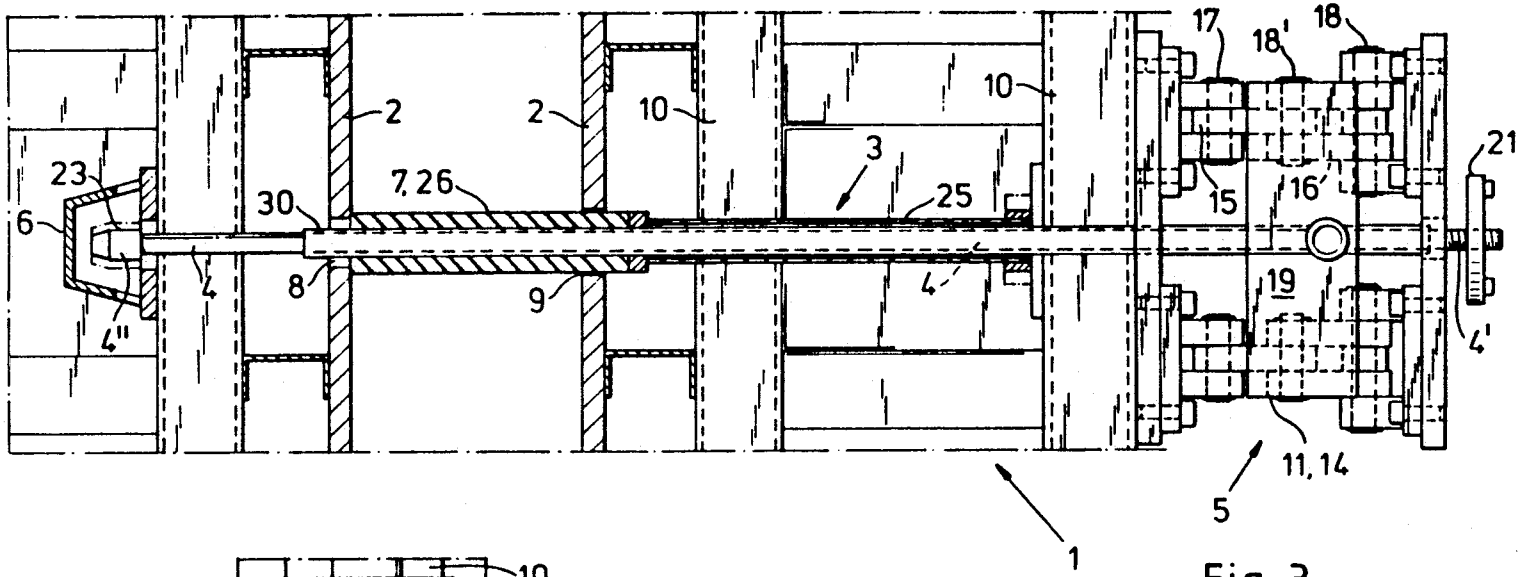
FIG. 3 is a schematic vertical and central sectional view of a second embodiment of an inventive form tie mounted adjacent two form bottoms.

Preferred embodiments are those in which both the support parts and the eccentric has parts on both sides of the longitudinal axis of the tension element, as illustrated in FIG. 3, in which case the longitudinal axis of said tension element preferably forms a symmetry line.

Figure 2:
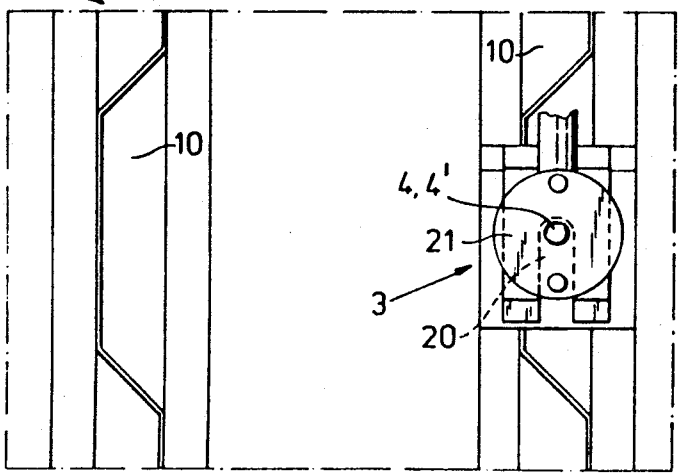
FIG. 2 illustrates the arrangement of FIG. 1 as seen from the right in said Figure.
Figure 4:
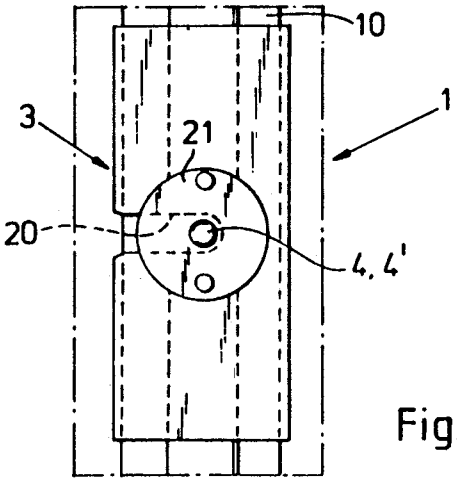
FIG. 4 illustrates the arrangement of FIG. 3 as seen from the right in said Figure.

As illustrated in broken lines in FIG. 1, it is also preferred that part of the eccentric locking device can be dropped away from the tension element, so as to enable the tension element to be withdrawn and removed from the form. Shown in the drawings is an embodiment in which said second support part has provided therein a U-shaped aperture or slot 20 which enables the support part to straddle the tension element. Also shown is an embodiment in which the end 4' of the tension element intended for coaction with the eccentric locking device is provided with a stop-means 21 which can be moved in the direction of the longitudinal axis of the tension element and which functions to subject the tension element to tension forces. In the illustrated case, the stop-means is moved by means of screw threads or helix 22. In the case of the embodiment illustrated in FIGS. 1 and 2, parts of the eccentric locking device can be moved towards and away from the tension element in a substantially vertical plane. In the embodiment illustrated in FIGS. 3 and 4, such movement can be effected substantially horizontally, through the intermediary of a U-shaped aperture 20, among other things.

The second fixating or securing element 6 is intended to detachably coact with an end part 4" of the tension element opposite said eccentric locking device in a manner to maintain tension force in the tension element, said tension element being brought into coaction with the fixating element. According to one preferred embodiment, the aforesaid end-part 4" includes a portion 23 of elongated cross-section, such as an oval or rectangular cross-section, as seen transversely to the long axis of the tension element, wherein corresponding fixating elements include an elongated hole 24 into which the elongated portion 23 can be inserted when in a given rotational position, shown in broken lines in FIG. 1, and which cannot be withdrawn from said hole when in another position of rotation, shown in full lines in FIG. 1. The fixating element 6 of this embodiment is mounted adjacent a form column 10 of the form bottom 1.

According to another embodiment (not shown), the end-part 4" is screw-threaded and the fixating element includes a corresponding nut means.

The sealing element 7 is intended to coact sealingly with the mutually opposing holes 8, 9 provided in the form boards 2, while under axial compression. The reference 25 identifies a spacer arranged between an external part, such as a load-carrying part 10, of a form side and an end-part 7' of the sealing element, said spacer functioning to compress the sealing element axially. In the illustrated embodiment, the spacer is placed externally adjacent the same form bottom as the eccentric locking device and extends between a load-carrying part 10 of the form bottom and an end-part 7' of the sealing element projecting externally from the hole 9 facing towards the eccentric locking device in a corresponding form side.

In the case of the illustrated configuration of the sealing element, the one end 7" of the sealing element, the end of the sealing element remote from the eccentric locking device, covers one of said holes, the hole 8, internally of a form board and is pressed axially against shuttering or form parts which surround the periphery of said hole in order to effect a seal. Shown is an embodiment in which the end of the sealing element remote from the eccentric locking device overlaps said hole.

FIG. 3 illustrates an embodiment in which the sealing element is comprised essentially of an elastic sleeve 26, for instance a sleeve made of plastic material, a rubber-based material or the like, and is intended to be compressed pronouncedly in an axial direction and thus to expand radially and seal the holes 8, 9.

In the case of the FIG. 1 embodiment, the sealing element 7 includes resilient parts 27, 28 for coaction with said holes 8, 9, these resilient parts being intended for pronounced axial compression and are supported by intermediate parts 29 which are not compressed to any great extent.

A preferred embodiment is one in which one end 7" of the sealing element covers the holes while the other end of said element extends through a hole and sealing is effected by radial expansion therein, for instance in the hole 9. According to one preferred embodiment, the resilient or elastic parts of the sealing element intended for axial compression are made of ADIPRENE (a trademark of E. I. duPont de Nemours & Co.) or some similar material, where the elastomeric material will not fasten essentially onto concrete that comes into contact with the sealing element ADIPRENE is an Organic Vulcanizable Synthetic Urethane Rubber.

The aforesaid intermediate parts 29, which are not intended to be compressed axially, are preferably made of ROBALOM (a registered Swedish trademark for a hard organic polymer plastic, e.g., polyurethane plastic), or some similar material, and are essentially conical in shape, thereby to facilitate withdrawal of said intermediate parts upon completion of a casting operation. The intermediate parts 29 are also not intended to fasten against the concrete, and are constructed to this end.

The reference 30 identifies a support tube in which the tension element extends, at least between the sides of the form.

Figure 5:
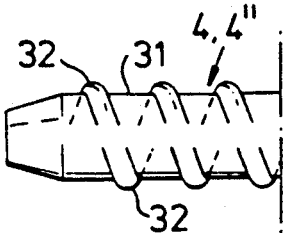
FIG. 5 illustrates a tension element as seen transversely to its longitudinal axis.
Figure 6:
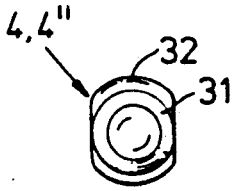
FIG. 6 illustrates the tension element of FIG. 5 as seen from the left in said Figure.
Figure 7:
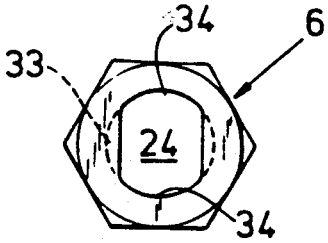
FIG. 7 illustrates a fixating element which is intended for coaction with the tension element of FIGS. 5 and 6, seen in the direction of its longitudinal axis.

In the embodiment of the tension element 4 and the fixating element 6 illustrated in FIGS. 5-7, at least the aforesaid end-part 4" includes a rod-like portion 31 having opposing cam parts 32 which give an elongated, oval, cross-sectional shape and which form a screw thread or helix, wherein corresponding fixating element 6 includes an elongated hole 24 provided with an internal screw thread 33, said holes and screw threads 33 being disposed such that the portion of elongated cross-sectional shape can be inserted into the elongated hole 24 in a given position of rotation and can be removed from said hole in another position of rotation.

According to one preferred embodiment, the tension element comprises an element retailed under the tradename DIWIDAG. The fixating element 6 includes a nut which is retailed under the tradename DIWIDAG. The screw threads, however, are cut or machined on two diametrically opposing parts 34, so as to form said oval, cross-sectional shape.

Figure 8:
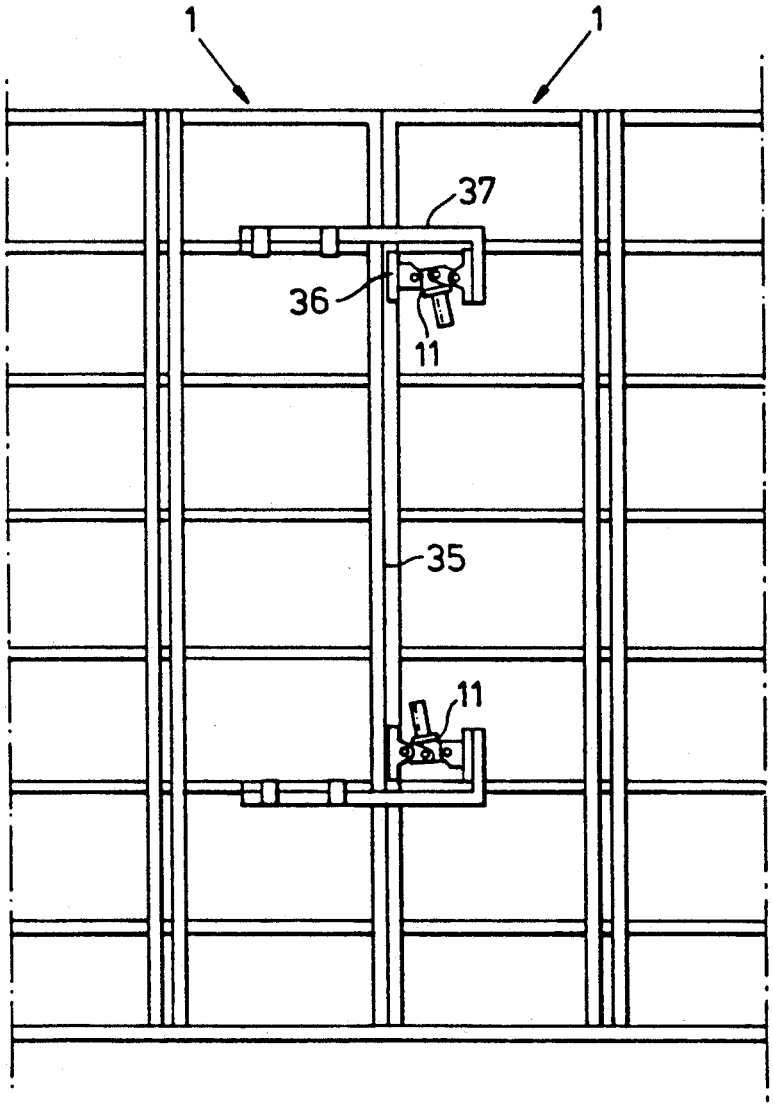
FIG. 8 illustrates schematically a first embodiment of an inventive form, in which two form-bottom parts, seen from the outside, are joined by means of eccentric locking devices.

The form embodiment illustrated in FIG. 8 includes at least two form elements, form bottoms, arranged in sequential rows. The form elements are held clamped and fixed in relation to one another at a join 35 by means of at least one (in the illustrated case two) eccentric locking device of essentially the kind described in the aforegoing and including, among other things, an eccentric part 11. The excentric locking device is intended to be in its expanded state when the form bottoms are clamped together. The form bottoms include fittings 36, 37 against which the eccentric locking device will act in a manner to draw the form bottoms towards one another. In the illustrated case, a form bottom includes outwardly projecting tensioning means 37 in which a tension force which holds the form bottoms together can be applied by means of respective eccentric locking devices.

Figure 9:
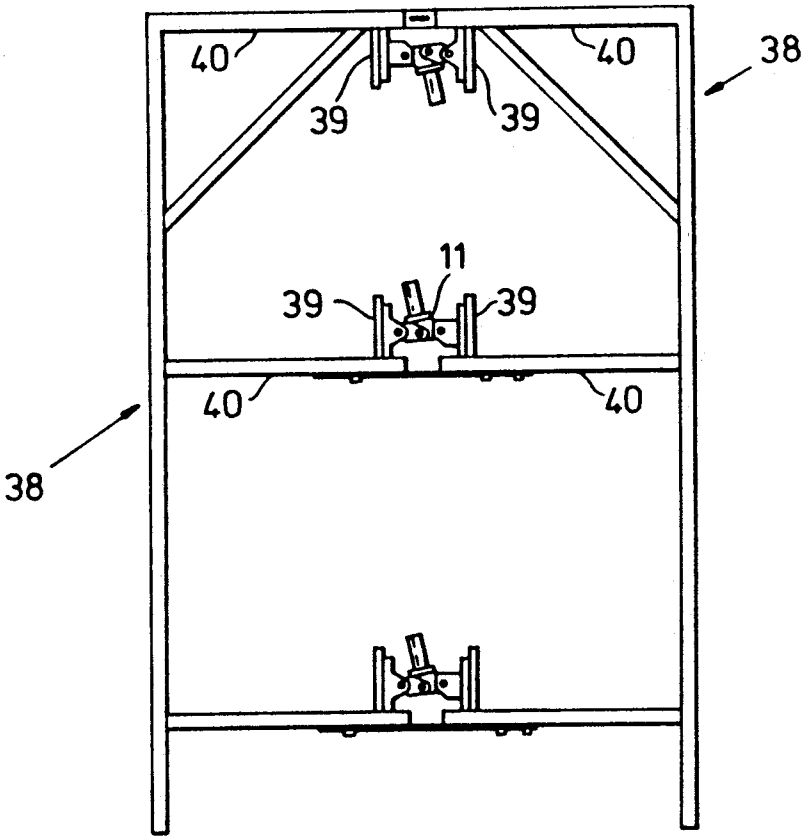
FIG. 9 illustrates schematically a second embodiment of an inventive form, where the form comprises a form for producing window and door openings and with which form elements are held at predetermined distances from one another by means of eccentric locking devices, and in which Figure the form is shown at right angles to the plane of the main extension of the window or door opening.

FIG. 9 illustrates a form which is intended for casting door openings, window openings and the like. This form includes at least two form elements 38 which are held at a predetermined distance from one another such as to define an opening of predetermined width, where casting is intended to be effected externally against the form elements, which are held at a given distance apart by means of at least one (in the illustrated case three) eccentric locking devices in an expanded state, said form elements including fittings 39 against which respective eccentric locking devices are intended to act. The illustrated embodiment includes two form elements 38 in the form of substantially E-shaped frame elements disposed in opposing relationship. In this case, one eccentric locking device is arranged to act between each pair of mutually opposing, horizontal element-parts 40.

Figure 10:
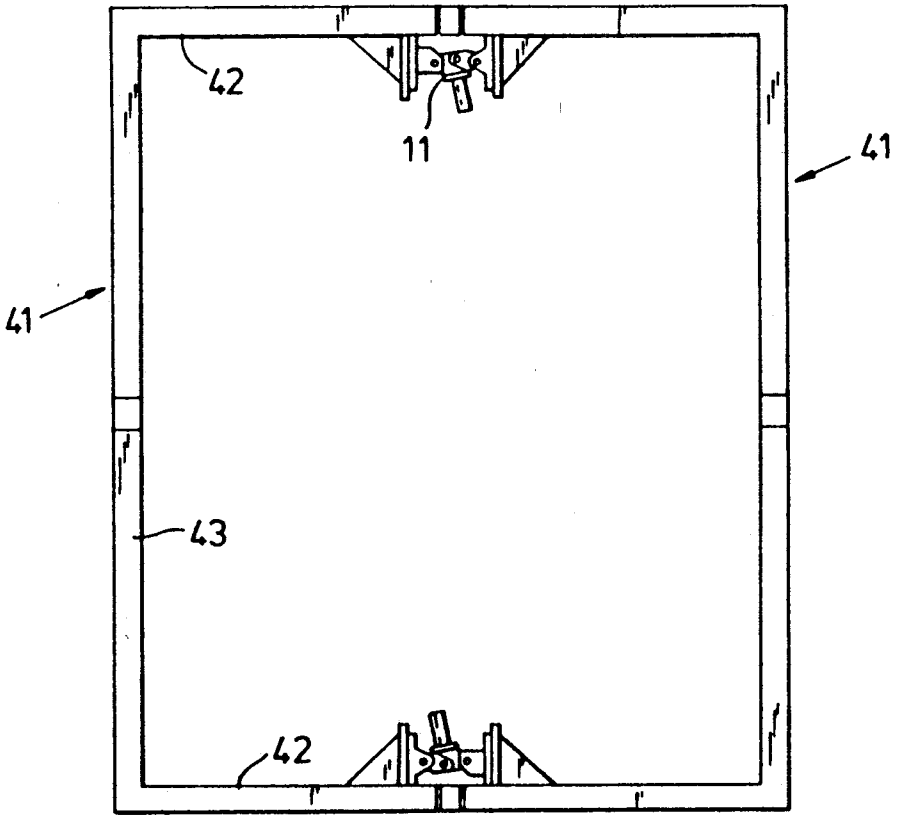
FIG. 10 illustrates schematically a third embodiment of an inventive form consisting of an internal form or shuttering for producing shafts, and with which the form elements are held at predetermined distances from one another by means of eccentric locking devices, said Figure showing the form in the intended direction of the shaft.

The internal shaft-building form illustrated in FIG. 10 includes two mutually opposite form elements 41, each of which comprises two side-parts 42 and an intermediate part 43, said parts forming a brace-like or clip-like cross-sectional shape. The form elements 41 are held at a given distance apart by means of at least two eccentric locking devices which, in their expanded states, act between each pair of mutually opposing side-parts 42.

In the case of the second embodiment of the clamping and fixating device illustrated in FIGS. 11–16, the eccentric part 11 of the eccentric locking device includes a linkage-arm arrangement 14 having two linkage arms, a first arm 44 and a second arm 45, which coact pivotally with a respective support part, a first support part 46 and a second support part 47, where the pivot joints permit rotation around mutually parallel pivot axles 48, 49, 50 which extend transversely to the expansion direction of the eccentric locking device and where each pivot includes at least one axle element 51, part of which has a cylindrical configuration, and a seat 52 which has a part of cylindrical configuration and which is intended for at least one axle element.

In the illustrated embodiment, (see FIGS. 11 and 12), there is included a first linkage arm 44 which includes a corner part 53 which extends parallel with said pivot axles 48-50 and which carries at its extremity a bead 51 having a partially a cylindrical configuration and forming an axle element and which forms a stop surface 54, 55 on each side of said bead, and further includes two stop surfaces 56, located opposite said bead and separated by a seat 52. The axle element, the bead, for this linkage arm, and also for the second linkage arm, is comprised of two transversal parts where the linkage arm is intended to straddle a tension element. As will be evident from the following, the stop surfaces on the linkage arms and the support parts are arranged to define a distinct, non-expanded position, in which each of the linkage arms adopts a first limited rotational position, and a distinct expanded position in which each of the linkage arms takes a second limited rotational position.

The embodiment also includes a second linkage arm 45 which includes two beads 51', 51'' which are partially of cylindrical configuration and each of which forms an axle element 51', 51'' separated by an intermediate stop surface 57. The linkage arm 45 also includes two opposing stop surfaces 58, 59 on opposite sides of the two beads in relation to said intermediate stop surface 57. Also included is a first support part 46 which is intended to coact with said first linkage arm 44 and which includes two stop surfaces 60, 61 separated by an intermediate seat 52 for the bead 51 of the first linkage arm 44 and each arranged for stopping coaction with a respective stop surface 54, 55 located on each side of the bead 51. The reference 47 identifies a second support and stop part which is intended to coact with said second linkage arm 45 and which includes two stop surfaces 62, 63 separated by an intermediate seat 52'' for the one and the other of the side abutments 57 and 59 of linkage-arm beads 51, 51', 51'', and each of which is arranged for stopping coaction with a respective one of the stop surfaces 57, 59 intermediate of the beads and the one of the two opposing stop surfaces of the second linkage arm 45, wherein the other of the beads of said second linkage arm is intended for the seat 52 of the first linkage arm, wherein the linkage arms are rotatable simultaneously between the stop surfaces of respective stop parts and herewith between their two limited rotational positions.

The first support part 46 is intended to support against supporting parts of a form element and to be through-passed by a tension element, wherein the support part is preferably displaceable freely along the tension element. The second support part 47 is preferably mounted on the tension element with the aid of screw threads 47' and is held in a given axial position on the tension element by means of said screw threads, wherein a radial hole is preferably provided for a locking screw or the like, not shown.

According to one preferred embodiment, the axle elements and the seats are included in the respective linkage arms and support parts, wherein said linkage arms and support parts with axle elements, etc. are formed integrally. The reference numeral 65 identifies a handle or the like mounted on the second linkage arm by means of which a switch between an expanded and a non-expanded state, and vice versa, can be made.

FIG. 17 illustrates a second embodiment of a second fixating element, in which said end-part 4'' includes a substantially cylindrical peg 66 having a circumferentially extending locking groove 66' and a part 67 connected axially therewith whose diameter is larger than the diameter of the peg and which carries externally a screw thread 68, which is preferably broken or interrupted in the circumferential direction. The fixating element also includes a locking sleeve 69 which is mounted on a preferably supporting part of a form element. The locking sleeve, in which said peg is intended to be inserted, includes an internal ball groove 70 extending circumferentially around said sleeve, and a latching pawl 71 which connects axially therewith and moves circumferentially, wherein two guide rings 72, 73 and at least one (in the present case two) intermediate locking balls 74 are arranged internally of the locking sleeve. The locking sleeve also includes an internal screw threaded part 75, which is preferably interrupted in the circumferential direction, wherein said guide rings 72, 73, in a first position, are intended to position the ball/balls in said ball groove 70, in which position the peg is not locked in the locking sleeve, and, in a second position, to position the ball/balls in said locking groove and radially inwardly of the latch, in which position the peg cannot be withdrawn from the locking sleeve, wherein said second position is intended to be taken subsequent to withdrawal of the peg from the locking sleeve to some extent and subsequent to rotation of the peg relative to the locking sleeve, to some extent.

The reference numeral 76 identifies friction elements, or sealing elements, which have the form of O-rings arranged between the guide ring 72 located nearest the free end 66 of the peg and said peg or the locking sleeve for axial displacement of the guide ring.

One embodiment of the invention, not shown, includes an array of spacers, preferably in the form of rings, which function to maintain a given distance between form boards, shuttering panels or the like, and which are placed between a supporting part of a form element connecting with an eccentric locking device and the supporting part of said eccentric locking device facing towards said form element, wherein at a given axial position of the eccentric locking device, the distance between the form boards or can be increased and decreased by inserting and removing spacers respectively, said spacer arrangement including a marking which discloses the distance prevailing at that time.

The manner in which the inventive clamping and fixating device works will be understood in all essentials from the aforegoing. The eccentric locking device enables a switch to be made between the two states of the eccentric device in a very gentle and quiet manner, even when the eccentric device is under load.

The manner in which the inventive form tie functions will also be understood in all essentials from the aforegoing. Thus, the tension element of the tie is intended to be manipulated from one side of the form, and fixation/-locking of the tension element can also be achieved from this same side of the form. The tension element is thus passed through holes in the sides of the form, such that the end of the tension element is in contact with a fixating element and can be locked axially thereto, by rotation. The excentric locking device is then activated, which when expanded holds the sides of the form in desired mutual positions. The sealing element is compressed axially by means of spacers, which are preferably rotatable, so as to seal against leakage from the cavity between the form sides. Subsequent to pouring concrete into the form and allowing the concrete to solidify or set, the sealing element is relieved of axial load, therewith causing the sealing element to contract radially and to release its contact with the concrete. Subsequent to bringing the excentric locking device to its non-expanded state, the locking parts can be moved away or to one side in a manner to enable the tension element and the sealing element to be withdrawn, removed and re-used.

The manner in which the inventive forms operate will also be evident from the aforegoing. Alternation between a moulding state and a non-moulding state can be effected quickly and quietly. The use of wedging arrangements and the drawbacks associated therewith are avoided.

As will be evident from the aforegoing, the invention affords important advantages in comparison with known technology. For instance, the form tie can be mounted very quickly and with precision. The wedge arrangement that requires the frequent use of sledge hammers and like devices is avoided. Sealing and locking of the tension element is effected simply and very efficiently, thereby enabling the load on both the sealing element and the tension element to be removed in a very simple fashion.

The advantages afforded by the inventive clamping and fixating devices and the inventive forms or shuttering will also be evident from the aforegoing.

Although the invention has been described with reference to a number of exemplifying embodiments, it will be understood that other embodiments and minor modifications are conceivable within the concept of the invention.

For example, the tension element 4 may be constructed in several ways. In the illustrated embodiments, the tension element has essentially the form of a rod. It will be understood, however, that the tension element may consist entirely or partially of a wire, cable or the like. The end/tip 4'' intended for coaction with an insert-type fixating element 6 may be fixed to the tension element, as illustrated in FIGS. 1 and 3, although it may also be pivotally mounted on said element.

The spacer 25 is preferably rotatable such as to take one position in which the sealing element is not subjected to axial compression and another position in which the sealing element is axially compressed.

Although Adiprene has been mentioned as an example of the elastomeric material from which the axially compressible sealing element is made, it will be understood that other plastic materials of the polyurethane type and corresponding materials may be used. In many cases, a material having a large spring constant is desired, i.e. a material which will provide large compression forces at relatively small compression.

Furthermore, although not shown, the holes that are left in the concrete by the sealing element and tension element can be filled with a so-called fibre repair rod. The diameter of the rod will preferably be slightly smaller than the diameter of the formed hole and is intended to be secured in the concrete with mortar which can be applied by dipping and which is preferably somewhat shorter than the length of the hole, for instance about 2 mm shorter. The repair rod will also have essentially the same diameter as the sealing element in its radially relaxed state.

The invention shall not therefore be considered limited to the aforedescribed and illustrated embodiments thereof, since modifications can be made within the scope of the following claims.

I claim:

1. A clamping and securing arrangement for concrete forms or shuttering, including an elongate tension element and a fixing device secured to each end of the tension element, functioning to hold two spaced-apart individual form elements in desired associated opposed positions against the force of concrete cast therebetween, the improvement being in that one of the fixing elements comprises: a locking device including an expandable eccentric means intended to modify tension force in the associated tension element, said expandable eccentric means having a predetermined axial extension dimension in an expanded state and a different axial extension dimension, which is smaller than said predetermined axial extension, in a non-expanded state, the axial extension being essentially in the direction of the elongate configuration of the tension element and in the direction of the force of the concrete cast between said two spaced-apart form elements; said expandable eccentric means further including an eccentrically expandable linkage-arm arrangement operable to change the axial extension dimension of the eccentric means said expandable linkage-arm arrangement comprising at least two support parts and at least two linkage arms which pivotally coact with each other and each of said linkage arms also pivotally coact with a respective associated one of said support parts, wherein said pivotal coactions of said linkage arms and said support parts permit rotation of said linkage arms about mutually parallel pivot axes which are disposed transverse to said expansion direction of said expandable eccentric means, and wherein each of said pivotal coactions includes at least one axle element of partially convex cylindrical configuration, and a seat of partially concave cylindrical configuration complementary to the partially convex cylindrical configuration of the associated axle element.

2. An arrangement according to claim 1, wherein said at least two linkage arms and the support parts with which the linkage arms are associated, each include stop abutment surfaces, which provide two distinct limit positions of the relative pivotal movement of said at least two linkage arms and their associated said support parts; a first of said two limit positions enabling said at least two support parts to be close together and to constitute the non-expanded axial state of said expandable eccentric means in which each of the said at least two linkage arms occupies a respective first, limited rotational position; and a second of said limit positions enabling a spaced-apart condition of said two support parts to constitute the expanded state of the axial extension dimension of said expandable eccentric means in which each of the said at least two linkage arms occupies a respective second, limited rotation position.

3. An arrangement according to claim 2 including a plurality of axle elements and a plurality of associated seats, wherein a first of said at least two linkage arms comprises a first of said seats and a corner part which is disposed opposite said first of said seats and parallel with said pivot axes and which corner part carries at its extremity a bead of partially cylindrical configuration constituting a first of said plurality of axle elements, said corner part having a said stop abutment surface on either side of said first axle element, and said first said linkage arm further including a said stop abutment surface on each side of its said first seat opposite said first axle element; and wherein said second of said at least two linkage arms comprises a set of two beads of partial cylindrical configuration, said set of two beads forming a second and a third of said axle elements separated in spaced-apart relationship by an intermediate one of said stop abutment surfaces, and two opposing said stop abutment surfaces on opposite sides of said second and third said axle elements in relation to said intermediate stop abutment surface; and wherein a first of said at least two support parts is disposed to coact with said first linkage arm and includes a second of said seats and two stop abutment surfaces adjacent said second seat, said second seat being for said first axle element of said first linkage arm and said stop abutment surfaces of said first support arm providing a limiting abutment with an associated one of the stop surfaces located on each side of the first axle element of said first linkage arm; and wherein a second of said two support parts is provided for coaction with said second linkage arm and includes two stop abutment surfaces and an intermediate third one of said plurality of seats separating its two stop abutment surfaces, said third seat receiving said third axle element of said second linkage arm, and the stop surfaces of said second support arm providing a limiting abutment with an associated one of the stop abutment surface which is intermediate of the second and third axle elements of the second linkage arm and a one of the said two opposite stop abutment surfaces of the second linkage arm; wherein the second axle element of the second linkage arm is disposed in said first seat in the first linkage arm; and wherein the said two linkage arms are rotatable simultaneously between positions determined by the stop abutment surfaces of the two linkage arms and the respective two support parts.

4. An arrangement according to claim 1, wherein said axle elements and the associated seats are integral parts of respective linkage arms and support parts, and wherein each linkage arm and each support part are formed integrally in a one piece structure.

5. An apparatus for molding concrete panel in a concrete form, said form comprising two opposing form bottoms provided with two spaced-apart opposed form boards with holes therein in alignment, maintained in a desired position, and wherein concrete is cast between and against said form boards and wherein said form includes at least one form tie comprising: an elongated tension-element, with two ends, extending between, and through said aligned holes in, said opposing spaced-apart form boards; two tension-element securing elements disposed on said tension-element ends externally of the form bottoms; and a sealing element, through which the tension element projects, located between the spaced-apart form boards, said sealing element being adapted to abut and seal against said two opposing form boards adjacent said aligned holes in said two form boards; and wherein a first of said securing element (5) has a securing component adapted to be fastened on a first end of said tension element, and also includes an eccentric locking device having an expandable eccentric means (11) to create tension in said tension elements, which eccentric means, in an expanded state, wherein it is locked and provides a predetermined distance between the form boards (2) wherein tension forces in the tension element oppose compression forces on the form bottoms resulting from poured concrete into the concrete form.

6. An apparatus according to claim 5, wherein the form bottoms have load-bearing parts and said eccentric locking device and its expandable eccentric means includes: a first support part which is disposed to abut against a load-bearing part of a one form bottom (1), and a second support part which is intended to take a given axial position adjacent the securing component of said first securing element relative to the associated said form tie tension element (4), so that a tension force can be applied by said second support part to the tension element, and an eccentrically expandable linkage-arm arrangement pivotally interconnecting said first and said second support parts and which functions, in a first non-expanded position, to hold the support parts close together in the longitudinal direction of the tension element, said tension element being relieved of load at this stage, and functions in a second extended position, to hold the support parts separated from one another in the longitudinal direction of the tension element, wherein the tension element may be subjected to a tensile force.

7. An apparatus according to claim 5, wherein said eccentric locking device and its expandable eccentric means include linkage arms which are pivotally mounted on mutually parallel axes which are positioned transversely to the longitudinal direction of the elongate tension element; and wherein said linkage arms are inter connected by an eccentric structure which is pivotal about a pivot axis which extends substantially parallel with the axes of said linkage arms, wherein the eccentric locking device can be shifted between a non-expanded state and an expanded state by rotation of said eccentric structure.

8. An apparatus according to claim 6, wherein said eccentrically expandable linkage-arm arrangement includes two linkage arms are and an eccentric part which have mutually pivotal coaction with each other and with a respective support part where the pivotal coaction permits rotation about mutually parallel pivot axes disposed to extend transversely to the expansion direction of the eccentric locking device, and where each pivotal coaction includes at least one axle element of partially convex cylindrical configuration and a complementary seat of partial concave cylindrical configuration enabling associated cooperation with said axle element.

9. An apparatus according to claim 7, wherein both the respective support parts and the linkage-arm arrangement have parts located on two sides of the first end of the elongated tension element (4).

10. An apparatus according to claim 5, wherein part of the eccentric locking device can be moved away from the tension element (4) so as to enable said element to be withdrawn and removed from the form.

11. An apparatus according to claim 5, wherein said securing component fastened on the first end of the tension element comprises a stop-part which can be adjustably fixed on, and against movement in the longitudinal direction of, the tension element and which is adapted to coact with said eccentric locking device to apply tension force to said tension element.

12. An apparatus according to claim 5, wherein a second of said securing elements is disposed to detachably coact with a second end of the tension element to cooperate with said eccentric locking device at the first end of the tension element to maintain a tension force in the tension element, and wherein the tension element is arranged to be fastened to the second securing element by relative rotation of the tension element and said second securing element.

13. An apparatus according to claim 12, wherein said second end of the tension element includes a part of elongated cross-sectional shape transversely to the longitudinal direction of the tension element, and in that said second securing element includes an elongated cross-section hole into which the elongated cross-sectional shaped part of said tension element can be inserted in a given position of relative rotation of said tension element and securing element and from which said elongated part cannot be withdrawn in another position of relative rotation of said tension element and securing element.

14. An apparatus according to claim 12, wherein said second end of the tension element is screw threaded, and in that the second securing element comprises a corresponding nut means.

15. An apparatus according to claim 12, wherein at least said second end of said tension element includes a rod-like part having opposing cam parts which form an elongated cross-sectional configuration including a screw-thread configuration; and in that said second securing element (6) includes an elongated hole having an internal screw thread, so that the part of elongated cross-sectional configuration can be inserted into the elongated hole (24) in a given position of relative rotation of said tension element and whereas said tension element cannot be withdrawn from said securing element (24) under mutual coaction of the screw threads where said tension element is in another position of relative rotation.

16. An apparatus as defined in claim 12, wherein said second end of said tension element includes a substantially cylindrical peg (66) which is provided with a circumferentially extending first locking groove (66'), and an end flange part (67) connected to said peg and having a greater diameter than the peg and which carries external screw threads (68), interrupted in the circumferential direction; and by a locking sleeve (69) which is said second securing element (6) and into which locking sleeve said peg is intended to be inserted and which locking sleeve includes an internal, circumferentially extending second ball locking groove (70), a latching pawl (71) connecting therewith, wherein two guide rings (72, 73) and at least one intermediate locking ball (74) are arranged internally in relation to the locking sleeve; and an internal screw threaded part (75) on said locking sleeve which is preferably interrupted in the circumferential direction, and wherein said guide rings are disposed, in a first position, to position the ball or balls (74) in said second ball locking groove (70), said peg being locked in the locking sleeve in said first position, and, in another second position, to position the ball or balls (74) in said first locking groove (66') and, radially, inwardly of said latching poll (71), in which position the peg cannot be withdrawn from the locking sleeve, wherein said second position is taken subsequent to withdrawing the peg to a given extent from the locking sleeve and subsequent to rotation of the peg in relation to said sleeve.

17. An apparatus according to claim 16, wherein a friction element (76), in the form of O-ring, is arranged between at least one of the guide rings (72) and the peg and locking sleeve respectively for axial displacement of said guide ring.

18. An apparatus as defined in claim 5, wherein the sealing element (7) is disposed for sealing coaction with the opposing holes (8, 9) in the two opposing form boards (2) when said sealing element is under axial compression.

19. An apparatus according to claim 18, wherein a spacer element (25) is arranged between an external load-bearing part (10) of a form bottom (1) and an end-part (7') of the sealing element, said spacer element functioning to axially compress the sealing element.

20. An apparatus according to claim 19, wherein the spacer element (25) is mounted externally of the same form bottom (1) as the eccentric locking device and extends between a load-bearing part (10) of the form bottom and a part (7') of the sealing element which protrudes outwardly from the hole (9) in the form side remote from the eccentric locking device.

21. An apparatus according to claim 19, wherein the spacer element (25) is pivotally mounted and is arranged so that it can be rotated to a position in which the sealing element is not subjected to axial compression and to a position in which the sealing element is subjected to axial compression.

22. An apparatus according to claim 18, wherein a first end (7'') of the sealing element is intended to cover one (8) of said holes internally of a form board (2) and is intended to be pressed axially against those parts of the form board (2) which define the periphery of said one hole so as to effect a seal.

23. An apparatus according to claim 22, wherein said first end (7'') of the sealing element is remote from the eccentric locking device.

24. An apparatus according to claim 5, a support tube (30) is provided and is placed over said tension element and extends at least between the two form boards

25. An apparatus according to claim 5, wherein the sealing element (7) essentially comprises a sleeve (26) made from an elastomeric material intended for pronounced compression in an axial direction.

26. An apparatus according to claim 5, wherein the sealing element (7) includes elastic parts (27, 28) for coaction with said holes (8), said parts being intended for pronounced axial compression and being carried by intermediate parts (29) which are not intended to be compressed to any substantial degree.

27. An apparatus according to claim 26, wherein the parts (26, 27, 28) of the sealing element (7) intended for axial compression are made of a synthetic urethane rubber which essentially will not fasten to concrete coming into contact with the sealing element.

28. An apparatus according to claim 26, wherein the parts (29) of the sealing element which are not intended for compression are made of an organic polymer plastic and are of substantially conical shape, thereby to facilitate withdrawal upon completion of a casting operation.

29. An apparatus according to claim 5, wherein, subsequent to completion of a concrete casting operation, said sealing element and tension element are replaced with a repair rod made from fibre concrete which functions to repair the hole left by said two elements when removed from the cast concrete.

30. An apparatus according to claim 29, wherein said repair rod has a diameter which is smaller than the diameter of the formed hole and is intended to be secured in the concrete with mortar applied by dipping and which repair rod is shorter by about 2 mm. than the length of the hole.

31. An apparatus according to claim 29, wherein the sealing element is expandable in a radial direction, and wherein the repair rod has essentially the same diameter as the diameter of the sealing element when said sealing element is in a radially relaxed state.

* * * * *